US011154764B2

(12) United States Patent
Brandl et al.

(10) Patent No.: US 11,154,764 B2
(45) Date of Patent: Oct. 26, 2021

(54) BRAKE DEVICE

(71) Applicant: MARKER Deutschland GmbH, Penzberg (DE)

(72) Inventors: Christian Brandl, Garmisch-Partenkirchen (DE); Robert Bartl, Grainau (DE)

(73) Assignee: MARKER DEUTSCHLAND GMBH, Penzberg (DE)

( * ) Notice: Subject to any disclaimer, the term of this patent is extended or adjusted under 35 U.S.C. 154(b) by 0 days.

(21) Appl. No.: 16/830,712

(22) Filed: Mar. 26, 2020

(65) Prior Publication Data

US 2020/0306615 A1 Oct. 1, 2020

(30) Foreign Application Priority Data

Mar. 29, 2019 (DE) ..... 10 2019 108 350.8

(51) Int. Cl.
*A63C 7/10* (2006.01)

(52) U.S. Cl.
CPC ..... *A63C 7/1013* (2013.01); *A63C 7/1093* (2013.01)

(58) Field of Classification Search
CPC ..... A63C 7/00; A63C 7/005; A63C 9/006; A63C 9/082; A63C 9/0805; A63C 9/08
USPC ..... 280/604, 605
See application file for complete search history.

(56) References Cited

U.S. PATENT DOCUMENTS 4,366,968 A * 1/1983 Klubitschko ..... A63C 7/1013 280/605
4,371,187 A * 2/1983 Svoboda ..... F16F 1/126 280/605
4,453,731 A * 6/1984 Krob ..... A63C 7/1026 280/605
4,463,967 A * 8/1984 Klubitschko ..... A63C 7/104 280/605
4,498,685 A * 2/1985 Zoor ..... A63C 9/081 280/605
4,537,418 A * 8/1985 Knabel ..... A63C 7/1033 280/605
4,544,177 A * 10/1985 Svoboda ..... A63C 7/104 280/605
4,564,211 A * 1/1986 Luitz ..... A63C 7/104 280/605

(Continued)

FOREIGN PATENT DOCUMENTS

EP 2662121 A2 11/2013
EP 2813268 A1 12/2014

OTHER PUBLICATIONS

European Search Report for European Application No. 19 206 528.2, dated Apr. 24, 2020, 9 pages.

*Primary Examiner* — Jeffrey J Restifo
(74) *Attorney, Agent, or Firm* — RatnerPrestia

(57) ABSTRACT

A brake device for a sliding board, including: a base for connecting the brake device to the sliding board; and a brake, including: at least one brake paddle; a latching element which can be moved back and forth between a first position in which the brake paddle can be released in order to slow the sliding board and a second position in which the brake paddle can be fixed in a non-braking position; and a pedal which includes a bearing area for a boot and a functional element which can be moved relative to the bearing area, wherein moving the functional element releases the latching element to be moved from the first position to the second position.

18 Claims, 12 Drawing Sheets

(56) References Cited

Figure 1:
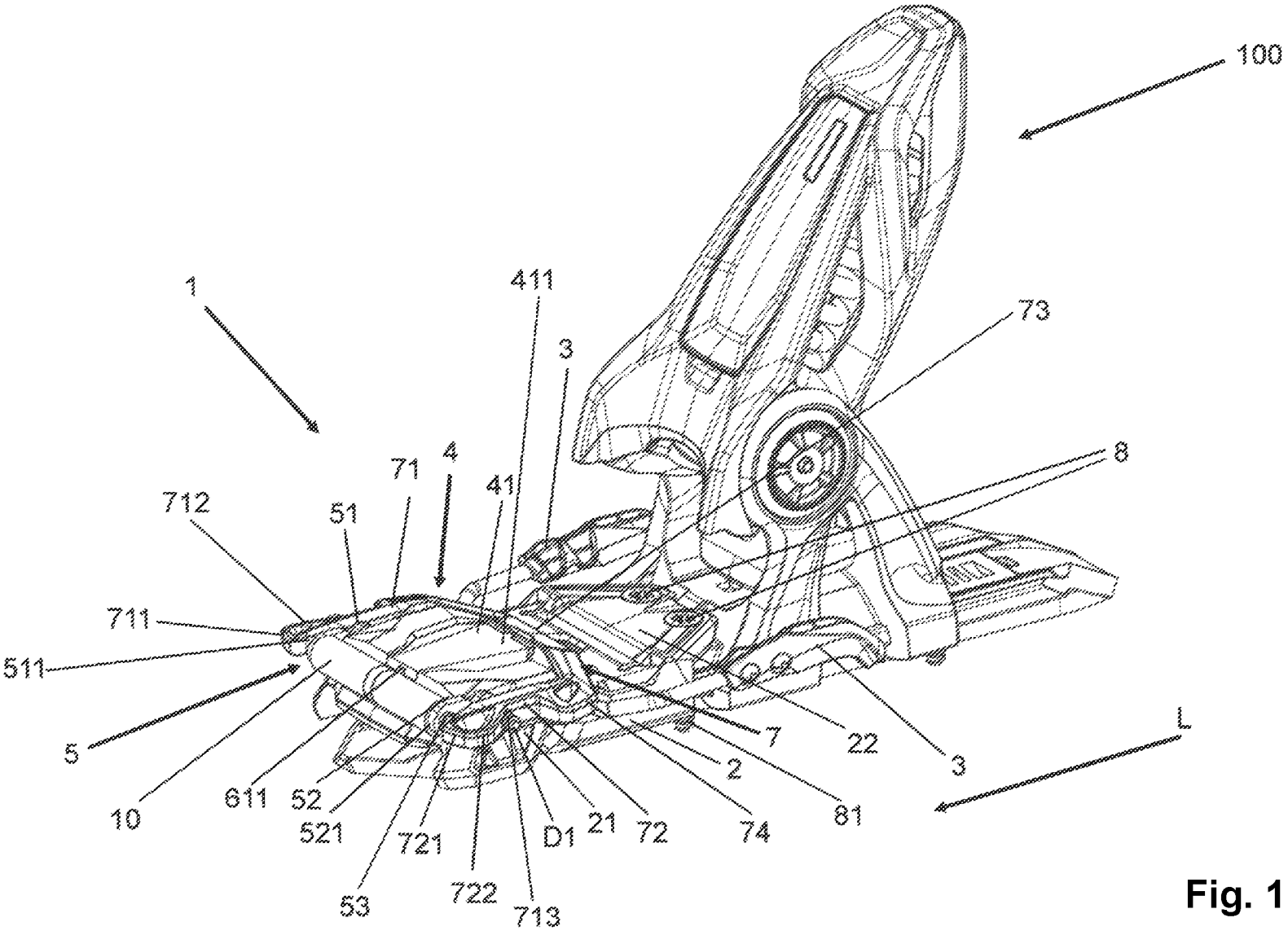

U.S. PATENT DOCUMENTS 4,573,700 A * 3/1986 Beyl ..... A63C 7/1026 280/605
4,676,520 A * 6/1987 Gasquet ..... A63C 7/1093 280/605
4,708,360 A * 11/1987 Peyre ..... A63C 7/104 280/605
RE32,567 E * 12/1987 Emert ..... A63C 7/104 280/605
4,856,806 A * 8/1989 Arduin ..... A63C 7/1066 280/605
4,872,698 A * 10/1989 Szafranski ..... A63C 7/1046 280/605
4,878,687 A * 11/1989 Stritzl ..... A63C 7/104 280/605
RE33,540 E * 2/1991 Sedlmair ..... A63C 7/1026 280/605
5,004,065 A * 4/1991 Goud ..... A63C 7/1026 280/605
5,033,766 A * 7/1991 Sedlmair ..... A63C 7/104 280/605
5,069,473 A * 12/1991 Erdei ..... A63C 7/1093 280/605
5,150,912 A * 9/1992 Lucas ..... A63C 7/1033 280/605
5,158,317 A * 10/1992 Sedlmair ..... A63C 7/104 280/605
5,265,901 A * 11/1993 Gorza ..... A63C 7/1013 280/605
5,324,062 A * 6/1994 Rigal ..... A63C 7/1013 280/605
5,362,086 A * 11/1994 Baron ..... A63C 7/1013 280/605
5,397,149 A * 3/1995 Couderc ..... A63C 5/075 280/602
5,516,141 A * 5/1996 Stritzl ..... A63C 7/104 188/6
5,540,458 A * 7/1996 Arduin ..... A63C 5/075 280/602
5,551,721 A * 9/1996 Renaud-Goud ..... A63C 7/1026 280/605
5,630,608 A * 5/1997 Luitz ..... A63C 7/104 280/605
5,642,897 A * 7/1997 Couderc ..... A63C 5/075 280/605
5,730,457 A * 3/1998 Couderc ..... A63C 5/075 280/602
5,816,602 A * 10/1998 Hayashi ..... A63C 7/1066 280/604
6,022,039 A * 2/2000 Chevalier ..... A63C 7/1033 280/605
6,073,955 A * 6/2000 Chonier ..... A63C 7/1093 280/604
6,244,617 B1 * 6/2001 Chonier ..... A63C 7/1013 280/605
6,254,119 B1 * 7/2001 Bardin ..... A63C 7/1026 280/605
6,293,576 B1 * 9/2001 Hunter ..... A63C 5/06 280/28.11
6,390,491 B1 * 5/2002 Hunter ..... A63C 5/00 280/604
6,443,477 B2 * 9/2002 Bardin ..... A63C 7/10 188/5
6,623,027 B1 * 9/2003 Wheeler ..... A63C 9/0807 280/604
6,659,494 B1 * 12/2003 Martin ..... A63C 9/0802 280/612
6,769,711 B1 * 8/2004 Martin ..... A63C 9/0802 280/625
6,877,759 B2 * 4/2005 Dandurand ..... A63C 9/20 280/605
7,249,785 B2 * 7/2007 Resch ..... A63C 7/1026 280/605
7,422,227 B2 * 9/2008 Riedel ..... A63C 9/02 280/601
7,458,598 B2 * 12/2008 Giffin ..... A63C 9/02 280/605
7,819,418 B2 * 10/2010 Buquet ..... A63C 7/102 280/605
8,827,302 B2 * 9/2014 Fritschi ..... A63C 9/0807 280/623
9,138,630 B2 * 9/2015 Brandl ..... A63C 9/0807
9,868,047 B2 * 1/2018 Lapierre ..... A63C 7/102
9,901,806 B2 * 2/2018 Fritschi ..... A63C 9/0842
10,315,099 B2 * 6/2019 Shute ..... A63C 9/0846
10,463,946 B2 * 11/2019 Shute ..... A63C 7/1026
10,946,265 B2 * 3/2021 Zoor ..... A63C 9/0846
2013/0181427 A1 * 7/2013 Fritschi ..... A63C 7/1053 280/614
2013/0300089 A1 * 11/2013 Barthel ..... A63C 9/08528 280/631
2015/0290524 A1 * 10/2015 Soldan ..... A63C 9/086 280/615

* cited by examiner

BRAKE DEVICE

CROSS REFERENCE TO RELATED APPLICATION

This application claims priority to German Patent Application No. 10 2019 108 350.8, filed Mach 29, 2019, the contents of such application being incorporated by reference herein.

FIELD

The invention relates to a brake device for a sliding board, comprising: a base for connecting the brake device to the sliding board; and a brake comprising at least one brake element, a latching element which can be moved back and forth between a first position in which the brake element is released in order to slow the sliding board and a second position in which the brake element is fixed in a non-braking position, and a pedal which comprises a bearing area for a boot and a functional element, wherein the functional element can be moved relative to the bearing area.

BACKGROUND

Sliding board bindings which are also suitable for ascending using the sliding board are becoming more and more popular. In addition to a downhill mode (as with ordinary downhill bindings), these bindings also enable a touring mode in which the boot is pivotably held on the front jaw, while the heel of the boot can lift off the sliding board. An important safety aspect of these bindings is that a brake device of the sliding board binding reliably slows the sliding board in the downhill mode, for example when it detaches from the boot due to a fall. In the touring mode, by contrast, the brake device is to be securely prevented from being released. There is therefore a need for brake devices which can be reliably released in the downhill mode and securely held in a non-braking position in the touring mode.

SUMMARY

An aspect of the invention is a brake device which, when switching from the touring mode to the downhill mode and vice versa, can be simply and securely adjusted for the respective mode. Other aspects are that of providing a sliding board binding which comprises such a brake device and that of providing the brake device as a retrofit kit which, irrespective of a sliding board binding, can be acquired and latterly integrated into a sliding board binding.

One aspect of the invention relates to a brake device for a sliding board comprising a base for connecting the brake device to the sliding board, a brake comprising at least one brake element, a latching element which can be moved back and forth between a first position in which the brake element is released in order to slow the sliding board and a second position in which the brake element is fixed in a non-braking position, and a pedal which comprises a bearing area for a boot and a functional element, wherein the functional element can be moved relative to the bearing area, wherein the movement of the functional element releases the latching element in order to move from the first position to the second position and vice versa.

The sliding board binding can be a combined touring and downhill binding, comprising a front jaw which connects a front end of the boot to the sliding board in the touring mode and in the downhill mode and a rear jaw which connects the rear end to the sliding board in the downhill mode.

The base can be directly connected to the sliding board, for example by screws or by locking elements which the base comprises and which engage with complementary locking elements on the sliding board in order to connect the base and the sliding board to each other in a positive fit and/or in a force fit. Alternatively, the base can be slid onto a rail, which the sliding board comprises or which can be connected to the sliding board, and moved into a functional position on the rail and connected to the sliding board or fixed relative to the sliding board in said position. Other types of connection between sliding board binding elements which are known in the field of sliding boards, such as front jaws, rear jaws or brakes, are likewise encompassed by an aspect of the invention.

The brake element can be a known brake paddle which is pressed into or against the travelling surface for example by a spring force, in order to slow the sliding board, when it has for example detached from the boot in a fall. The brake generally comprises two brake elements which are coupled to each other in terms of their movement and can be moved substantially simultaneously into the braking position on either side of the sliding board.

The latching element can comprise an engaging element which, in order to latch the brake in the non-braking position, co-operates with a complementary latching element on the base or brake or on another part which does not move relative to the sliding board. During the movement from the first position to the second position or vice versa, the latching element can be linearly moved, rotated, pivoted or moved in some other way.

The movement of the functional element relative to the bearing area can be a linear movement, preferably along or transverse to a longitudinal axis of the sliding board, a pivoting movement about a pivot axis which preferably extends transverse or parallel to the longitudinal axis of the sliding board, or a rotational movement about a rotational axis which extends at an angle from the surface of the sliding board upwards towards the boot.

The movement of the functional element can release the movement of the brake, i.e. only then enable the movement of the brake from the non-braking position to a position in which the brake can act.

The functional element can then be moved from a first location, in which the functional element is not in contact with a boot which is inserted in the binding, to a second location in which the functional element is in contact with the inserted boot. An "inserted boot" can mean that the binding is in its downhill mode, i.e. the boot is fixedly held in the front jaw and in the heel retainer. In the touring mode, an "inserted boot" means that the boot is held on the front jaw, for example in a known way using two pins which form a pivot axis for the boot, such that the boot can lift freely off the sliding board but can also be lowered towards the pedal of the brake, wherein the first location of the functional element represents a downhill mode of the brake, whereas the second location of the functional element represents a touring mode of the brake, wherein to be "in contact" can mean that the functional element abuts the boot and the boot prevents the functional element from being unintentionally moved from the second location to the first location. In order to move the functional element from the first location to the second location, it can be necessary for the boot or, respectively, a lower side of the sole of the boot to be arranged at a distance from the bearing area, i.e. above or next to the bearing area. In one embodiment, the functional element remains in the second location even when it is not in contact with the boot.

In the second location, the functional element can for example lie above or on the surface of the bearing area. The inserted boot can then be lowered onto the functional element, such that in the touring mode in particular, the functional element forms a first ascending aid, for a height adjustment of ≤3°, preferably ≥0°, in the second location.

The functional element can be embodied as a lever. The lever can comprise a first connecting arm, comprising a first end and a second end, and preferably also a second connecting arm comprising a first end and a second end. The second end of the connecting arm or arms can be mounted and/or guided in the pedal, while the first end or ends can be gripped using a tool or preferably by hand in order to move the lever from the first location to the second location and back.

The lever comprising a first connecting arm and a second connecting arm can additionally comprise a transverse strut which connects the first end of the first connecting arm to the first end of the second connecting arm. In this case, the transverse strut can be embodied such that it can be gripped using a tool or by hand in order to move the lever from the first location to the second location and back.

The second end of the first connecting arm and the second end of the second connecting arm can then for example be connected to the pedal in a linear guide or in a pivot joint or rotary joint.

The transverse strut can be rotatably mounted in the first end of the first connecting arm and in the first end of the second connecting arm. The two connecting arms can for example comprise a drill hole at their respective end, with which axle-like ends of the transverse strut engage. The transverse strut can be manufactured from the same material as the two connecting arms or from a different material than the two connecting arms. The surface of the transverse strut can be structured, for example with grooves in the circumferential direction or longitudinal direction of the transverse strut or other structuring elements. The transverse strut can comprise a coating which consists for example of an elastic material such as a plastic. The transverse strut can be secured against laterally exiting the first connecting arm and second connecting arm.

Alternatively, the transverse strut can comprise at least one sleeve which at least partially surrounds it in the longitudinal direction of the transverse strut and is rotatably mounted on the transverse strut. The sleeve is preferably closed in the circumferential direction, such that it can only be slid onto the transverse strut or removed from the transverse strut from the side. The sleeve can be formed from a plastic or can comprise a plastic coating, wherein the plastic can be an elastic plastic. The exterior surface of the sleeve can be structured.

The rotatable transverse strut or the transverse strut comprising the rotatable sleeve can be advantageous if the boot or, respectively, the lower side of the sole of the boot exhibits a pronounced profile with which the transverse strut can engage when the functional element is in the second location. This prevents the lever from being able to become jammed in the profile, which would hamper walking in the touring mode. Another advantage can be that the boot, which is moved linearly relative to the sliding board in or counter to the longitudinal direction of the sliding board by the sliding board flexing, does not have to overcome any frictional forces of the transverse strut or sleeve.

In one embodiment, the functional element can be connected to the pedal such that it can be pivoted about an axis transverse to the longitudinal direction of the sliding board. It can be U-shaped and exhibit interior dimensions which substantially correspond to the exterior dimensions of the pedal. In the first location, the functional element can lie below a plane which spans the bearing area or the pedal; in the second location, the functional element can lie on the pedal in at least a point or line or over an area.

The latching element can be biased in the direction of the first or second position, such that when the functional element is moved from the first or second location to the second or first location, the latching element is moved automatically, or at least with assistance from the biasing force, into the first or second position. The latching element is preferably biased in the direction of the second position, wherein the functional element can form an abutment for the latching element in the first location and thus hold the latching element in the first position.

The brake device can comprise at least one second ascending aid which can be moved, for example pivoted or linearly shifted, from a resting position to an active position. In a resting position, this second ascending aid can be secured on the pedal in a positive fit and/or in a force fit, such that the second ascending aid cannot be unintentionally moved from the resting position to the active position.

In the resting position, the second ascending aid can increase the area of the pedal or bearing area for the boot. The second ascending aid can for instance lengthen the area in the direction of the longitudinal axis of the sliding board and/or broaden it in the transverse direction thereto. As already stated with respect to the functional element, the second ascending aid can also be arranged relative to the pedal in the resting position such that it does not contribute to increasing the size of the pedal or bearing area. Lastly, the second ascending aid can also lie partially within the bearing area in the resting position and then preferably forms part of a surface of the pedal.

Like the functional element, the second ascending aid can be U-shaped. In the resting position, the transverse strut of the second ascending aid can be arranged on a side of the pedal which lies opposite the side on which the functional element is arranged in the first position. In the resting position, the second ascending aid can in particular be arranged behind the functional element in the travelling direction of the sliding board, in relation to the longitudinal axis of the sliding board.

Like the functional element, the U-shaped second ascending aid can comprise two connecting arms, which each exhibit a free end, and a transverse strut which connects the two connecting arms to each other at an end region of the connecting arms which lies opposite the free ends. The second ascending aid can be originally molded in one piece, for example cast in a die-casting method, or joined from multiple parts. The first free ends of the second ascending aid can be connected to the pedal or base such that they can be moved, for example linearly moved or pivoted or rotated.

Both the functional element and the second ascending aid can respectively be connected to the base or pedal in a joint, such as a pivot joint or rotary joint, wherein the functional element can be connected in a first joint, and the ascending aid can be connected in a second joint. The first joint is preferably identical to the second joint, such that the functional element and the second ascending aid form the same joint with the base or pedal and can be moved relative to the base and relative to the pedal and relative to each other in the same joint. The common joint can be formed near an end of the brake device (which is connected to the sliding board) which is a front end in the travelling direction of the sliding board.

The second ascending aid can provide a height adjustment which is greater than the height adjustment of the functional element in the second location. The second ascending aid preferably provides a height adjustment of about 10°. To this end, the connecting arms of the second ascending aid can exhibit a greater length than the connecting arms of the functional element. Preferably, the second ascending aid can be moved out of the resting position only when the functional element is in the second location. The second ascending aid can be locked in at least one angular position or in two, three or more angular positions which provide different height adjustments. To this end, at least one of the connecting arms or both of the connecting arms of the second ascending aid can for example comprise an elongation, embodied as a locking finger or abutting element, at their free ends. The locking element or elements for the locking fingers or an abutment for the abutting element or elements of the second ascending aid can be formed on an exterior side of the base or pedal.

In order to be able to connect the brake device to the sliding board or fix it on the sliding board, the base of the brake device can comprise a drill hole pattern which is identical to a drill hole pattern of a known heel retainer, such that the brake device can be connected to the sliding board together with the heel retainer, using the same screw for example, in the same drill hole. The base can comprise a portion into which any drill hole pattern can be latterly introduced, in order to be able to combine the brake device with a large number of different heel retainers, wherein "heel retainers" can be regarded as also including a rail which can be connected to the sliding board by suitable means and onto which a rear jaw can be slid.

The latching element can comprise a first arm which extends substantially parallel to an upper side of the pedal and which comprises a free end which abuts the functional element directly or via one or more movement and/or force transmission elements when the functional element is in the first location.

The free end of the first arm of the latching element can be shaped such that the latching element can be moved from the second position to the first position when the functional element is moved from the second location to the first location, and vice versa, wherein the first arm can have a longitudinal extension in the longitudinal direction of the brake device which substantially corresponds to the longitudinal extension of the bearing area or pedal in the longitudinal direction of the brake device or is shorter.

The latching element can comprise at least one second arm which protrudes from the first arm at an angle. The angle can be chosen at will by the person skilled in the art; it can for example be between 70° and 110° or can be substantially 90°. The second arm, which protrudes from the first arm, can comprise a free end which forms an engaging element of the latching element which co-operates with a complementary latching element of the brake device in order to fix the brake in the second position on the sliding board, for example in the touring mode or for transport.

The latching element can also comprise at least one third arm which protrudes from the first arm, for example between the free end of the first arm and the at least one second arm. The at least one third arm can protrude from the first arm in any direction and at any angle; it can thus for example protrude in the same direction as the at least one second arm and extend parallel to the at least one second arm. The at least one third arm can for example form a counter bearing for a tensing element which biases the latching element into the second position. The tensing element can be a spring, for example a spiral spring, a leaf spring or a solid body made of an elastic material.

A second aspect of the invention relates to a ski binding for a sliding board comprising a front jaw or toe retainer, a rear jaw or heel retainer and a brake device such as has been described with respect to the first aspect.

The front jaw of the ski binding can comprise a first holding device for a front end of a boot and a second holding device for the front end of the boot, wherein the first holding device can connect the front end of the boot to the sliding board during walking, and the second holding device can connect the front end of the boot to the sliding board when descending.

The second holding device can be separably connected to the first holding device, such that the second holding device can be removed and carried separately from the first holding device for the purpose of walking or in the touring mode of the sliding board binding. In the downhill mode, the second holding device preferably enables the boot to be laterally released in the event of a fall.

The heel retainer can be any rear jaw which securely connects the boot to the sliding board for descending. The rear jaw can be rotatable about an axis which extends substantially parallel to the upper side of the sliding board, in order to allow the sliding board binding to be vertically released when descending. Preferably, the heel retainer cannot be closed as long as the functional element is in the second location in which it fixes the brake in the non-braking position. This prevents the sliding board from being able to be used for descending despite the brake device lacking any braking function.

In order to fix the brake device on the sliding board, the brake device can overlap the heel retainer in regions. The drill hole pattern of the brake device can align with a drill hole pattern of the heel retainer. The brake device in particular grips over or under the heel retainer in the region of the mutually aligned drill hole patterns. A connecting element can extend through aligned drill holes of the brake device and heel retainer and jointly connect the brake device and the heel retainer to the sliding board.

A third aspect of the invention relates to a sliding board comprising a ski binding according to the second aspect.

A fourth aspect relates to the brake device according to the first aspect, wherein the brake device comprising all its parts serves as a retrofit kit for a known sliding board binding. The retrofit kit comprising all the parts of the brake device is enclosed in secondary packaging and can be offered for sale to end customers on a shop floor as a separate kit, irrespective of a sliding board binding.

In order for example to switch from the downhill mode to the touring mode, the user must step out of the binding, thus releasing the brake device, i.e. the pedal can be moved upwards relative to the sliding board, and the brake elements of the brake can simultaneously be moved in the opposite direction. The user can then move the functional element from the first location to the second location, thus moving the latching element from the first position to the second position and enabling the sliding board to be used for the touring mode. When stepping back into the binding, the user presses the pedal downwards towards the sliding board and thus presses the latching element, which is now in the second position, into latching with the brake, whereby the brake elements can no longer be released.

Individual combinations of features, which can partially correspond to the claims, are disclosed in the following as aspects. These aspects can be adduced in order to complement claims or to serve as a basis for a divisional application.

Aspect 1. A brake device for a sliding board, comprising:

a base (2) for connecting the brake device (1) to the sliding board; and a brake, comprising:

at least one brake paddle (3);

a latching element which can be moved back and forth between a first position in which the brake paddle (3) can be released in order to slow the sliding board and a second position in which the brake paddle (3) can be fixed in a non-braking position;

and a pedal (4) which comprises a bearing area (41) for a boot (200) and a functional element (5) which can be pivoted relative to the bearing area (41), characterized in that pivoting the functional element (5) releases the latching element (6) to be moved from the first position to the second position.

Aspect 2. The brake device according to Aspect 1, wherein the functional element (5) can be pivoted from a first location, in which the functional element (5) lies next to the bearing area (41), to a second location in which the functional element (5) lies above a surface (411) of the bearing area (41).

Aspect 3. The brake device according to the preceding aspect, wherein the functional element (5) lies above the surface of the bearing area (41) in the second location.

Aspect 4. The brake device according to any one of the preceding two aspects, wherein the functional element (5) forms a first ascending aid for a height adjustment of 3° or less, preferably greater than or equal to 0°, in the second location.

Aspect 5. The brake device according to any one of the preceding aspects, wherein the functional element (5) comprises a first pivot arm (51) and a second pivot arm (52) which each have a first end (511, 521) and a second end (512, 522).

Aspect 6. The brake device according to the preceding aspect, wherein the functional element (5) comprises a transverse strut (53) which connects the first end (511) of the first pivot arm (51) and the first end (521) of the second pivot arm (52) to each other.

Aspect 7. The brake device according to any one of the preceding two aspects, wherein the second end (512) of the first pivot arm (51) and the second end (522) of the second pivot arm (52) are connected to the pedal (4) in a rotary joint (D1).

Aspect 8. The brake device according to any one of the preceding two aspects, wherein the transverse strut (53) is rotatably mounted in the first end (511) of the first pivot arm (51) and in the first end (521) of the second pivot arm (52) or comprises at least one sleeve (10) which partially surrounds the transverse strut (53) and is rotatably mounted on the transverse strut (53).

Aspect 9. The brake device according to any one of the preceding seven aspects, wherein the functional element (5) lies below a plane of the bearing area (41) in the first location.

Aspect 10. The brake device according to any one of the preceding aspects, wherein the latching element (6) is biased in the direction of the second position, such that when the functional element (5) is pivoted from the first location to the second location, the latching element (6) is moved automatically into the second position.

Aspect 11. The brake device according to any one of the preceding aspects, wherein the brake device (1) comprises at least one second ascending aid (7) which can be pivoted from a resting position to an active position.

Aspect 12. The brake device according to the preceding aspect, wherein in the resting position, the second ascending aid (7) is secured on the pedal (4) in a positive fit and/or in a force fit, such that the second ascending aid (7) cannot be unintentionally moved from the resting position to the active position.

Aspect 13. The brake device according to the preceding aspect, wherein in the resting position, the second ascending aid (7) lengthens the bearing area (41) in the longitudinal direction (L) of the brake device and/or broadens it.

Aspect 14. The brake device according to the preceding aspect, wherein in the resting position, the second ascending aid (7) lengthens the bearing area (41) on a side opposite the functional element (5) in the first position.

Aspect 15. The brake device according to any one of the preceding four aspects, wherein the second ascending aid (7) is substantially U-shaped and comprises a first free end (711) and a second free end (721).

Aspect 16. The brake device according to the preceding aspect, wherein the first free end (711) and the second free end (721) are connected to the pedal (4) in a pivot joint.

Aspect 17. The brake device according to the preceding aspect, wherein the pivot joint is identical to the rotary joint (D1) of Aspect 7.

Aspect 18. The brake device according to any one of the preceding seven aspects, wherein the second ascending aid (7) provides a height adjustment which is greater than the height adjustment of the functional element (5) in the second location.

Aspect 19. The brake device according to any one of the preceding aspects, wherein the base (2) comprises a drill hole pattern (8) which is identical to a drill hole pattern of a known heel retainer, such that the brake device (1) can be connected to the sliding board together with the heel retainer.

Aspect 20. The brake device according to any one of the preceding aspects, wherein the latching element (6) comprises a first arm (61) which extends substantially parallel to an upper side (411) of the bearing area (41) and which comprises a free end (611) which abuts the functional element (5) when the functional element (5) is in the first location.

Aspect 21. The brake device according to the preceding aspect, wherein the free end (611) is shaped such that the latching element (6) can be moved from the second position to the first position when the functional element (5) is moved from the second location to the first location.

Aspect 22. The brake device according to any one of the preceding two aspects, wherein the first arm (61) has a longitudinal extension in the longitudinal direction (L) of the brake device which substantially corresponds to the longitudinal extension of the bearing area (41) in the longitudinal direction (L) of the brake device.

Aspect 23. The brake device according to any one of the preceding three aspects, wherein the latching element (6) comprises at least one second arm (62) which protrudes perpendicularly from the first arm (61).

Aspect 24. The brake device according to the preceding aspect, wherein the at least one second arm (62) has a free end (621) which forms an engaging element of the latching element (6).

Aspect 25. The brake device according to any one of the preceding five aspects, wherein the latching element (6) comprises at least one third arm (63) which is arranged between the free end (611) of the first arm (61) and the at least one second arm (62).

Aspect 26. The brake device according to the preceding aspect, wherein the at least one third arm (63) extends substantially parallel to the at least one second arm (62).

Aspect 27. The brake device according to any one of the preceding two aspects, wherein the at least one third arm (63) forms a counter bearing for a tensing element (9) which biases the latching element (6) into the second position.

Aspect 28. The brake device according to any one of the preceding twenty aspects, wherein one or the at least one sleeve (10) is formed from plastic.

Aspect 29. The brake device according to any one of the preceding twenty-one aspects, wherein a surface of the sleeve (10) is structured.

Aspect 30. A ski binding for a sliding board, comprising:

a front jaw or toe retainer;

a rear jaw or heel retainer (100); and a brake device (1) according to any one of Aspects 1 to 29.

Aspect 31. The ski binding for a sliding board according to Aspect 30, wherein the front jaw comprises a first holding device for a front end of a boot (200) and a second holding device for the front end of the boot (200).

Aspect 32. The ski binding for a sliding board according to the preceding aspect, wherein the first holding device connects the front end of the boot (200) to the sliding board during walking, and the second holding device connects the front end of the boot (200) to the sliding board when descending.

Aspect 33. The ski binding for a sliding board according to any one of the preceding two aspects, wherein the second holding device is separably connected to the first holding device, such that the second holding device can be removed for the purpose of walking.

Aspect 34. The ski binding for a sliding board according to any one of the preceding four aspects, wherein the heel retainer (100) cannot be closed as long as the functional element (5) is in the second location.

Aspect 35. The ski binding for a sliding board according to any one of the preceding five aspects, wherein the brake device (1) and the heel retainer (100) overlap in regions and the drill hole pattern (8) of the brake device (1) aligns with a drill hole pattern of the heel retainer (100).

Aspect 36. The ski binding for a sliding board according to the preceding aspect, wherein the brake device (1) grips over the heel retainer (100) in the region of the aligned drill hole patterns.

Aspect 37. The ski binding for a sliding board according to any one of the preceding two aspects, wherein a connecting element (81) extends through aligned drill holes of the brake device (1) and heel retainer (100) and jointly connects the brake device (1) and the heel retainer (100) to the sliding board.

Aspect 38. A sliding board comprising a ski binding for a sliding board according to any one of Aspects 30 to 37.

Aspect 39. The brake device according to any one of Aspects 1 to 29, wherein the brake device (1) is a retrofit kit for a known sliding board binding.

DRAWINGS

In the following, an example embodiment of a brake device in accordance with aspects of the invention are described in more detail on the basis of figures. Aspects of the invention are not limited to the example embodiment shown; the scope of the invention is defined by the claims. Features essential to aspects of the invention which are only disclosed in or in connection with the figures form part of the scope of the invention.

Figure 2:
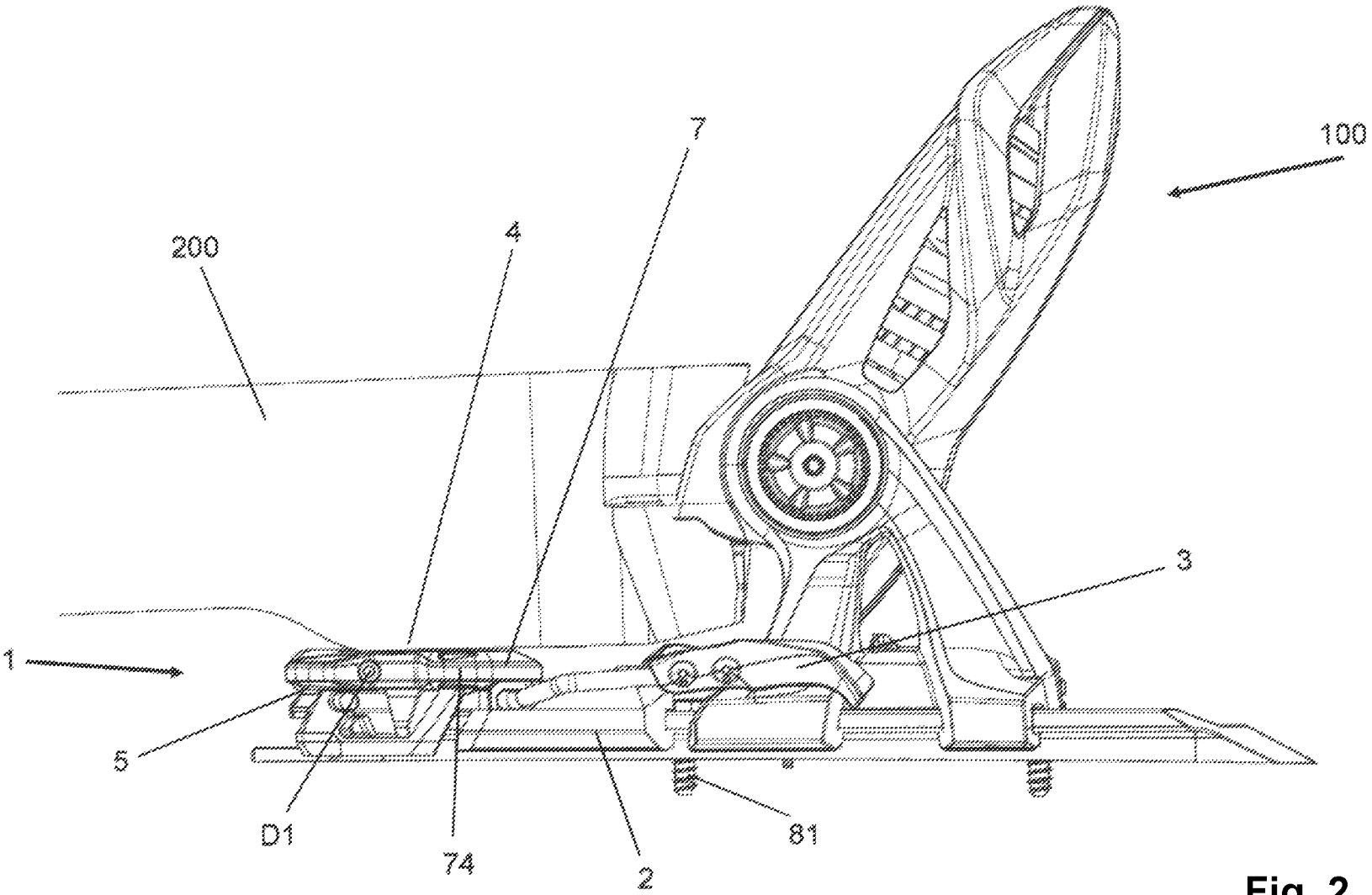
Figure 3:
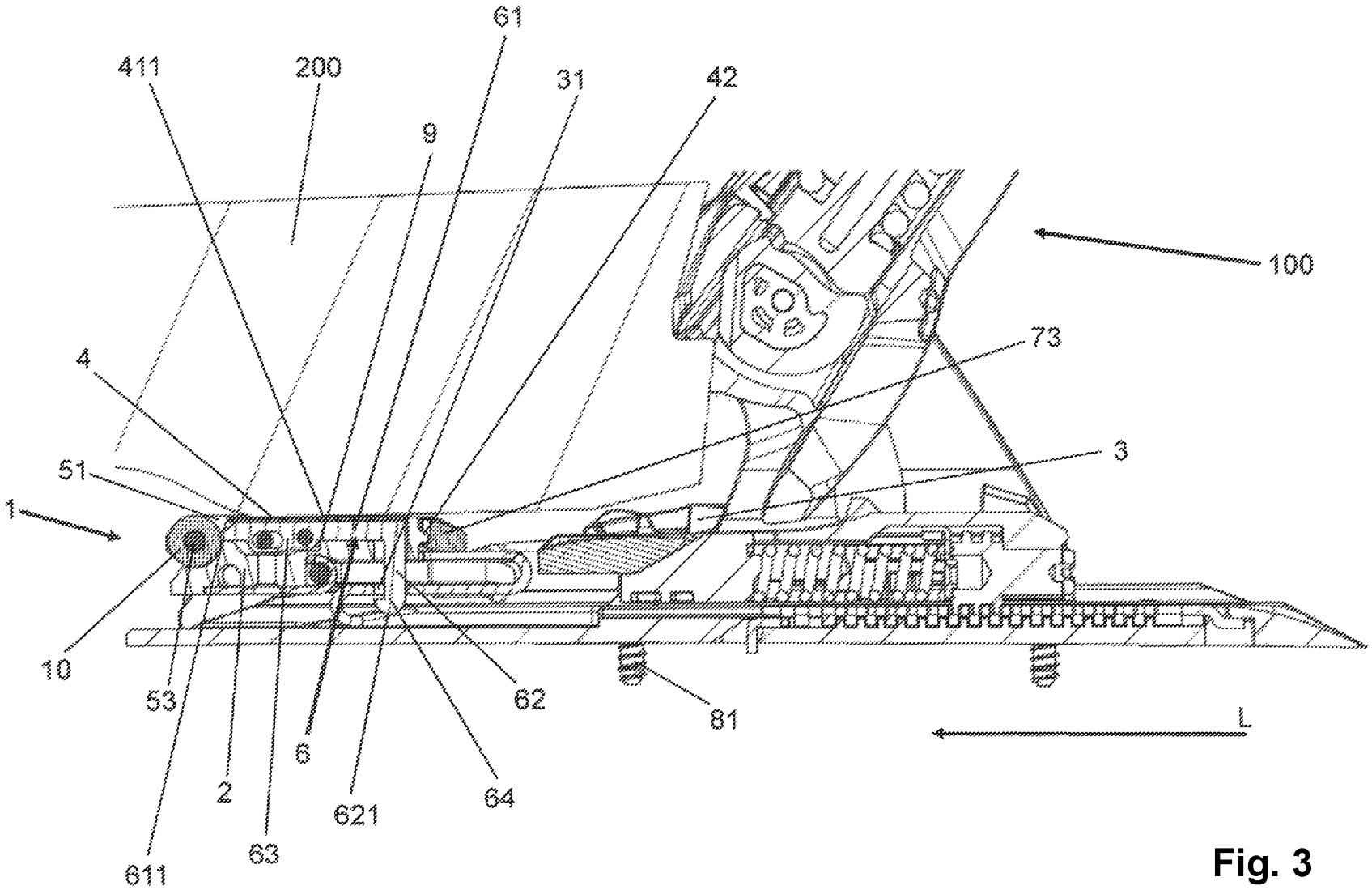
Figure 4:
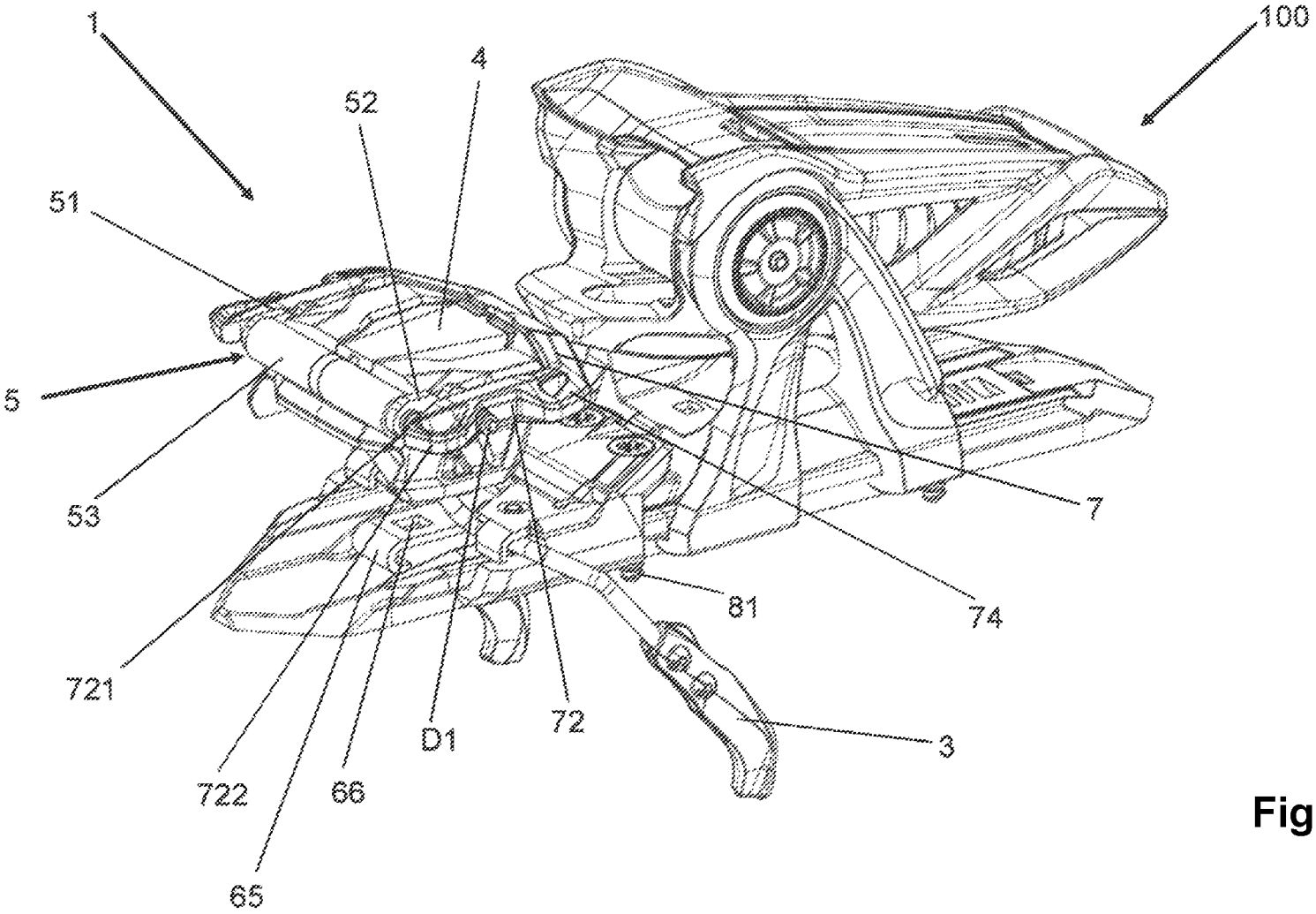
Figure 5:
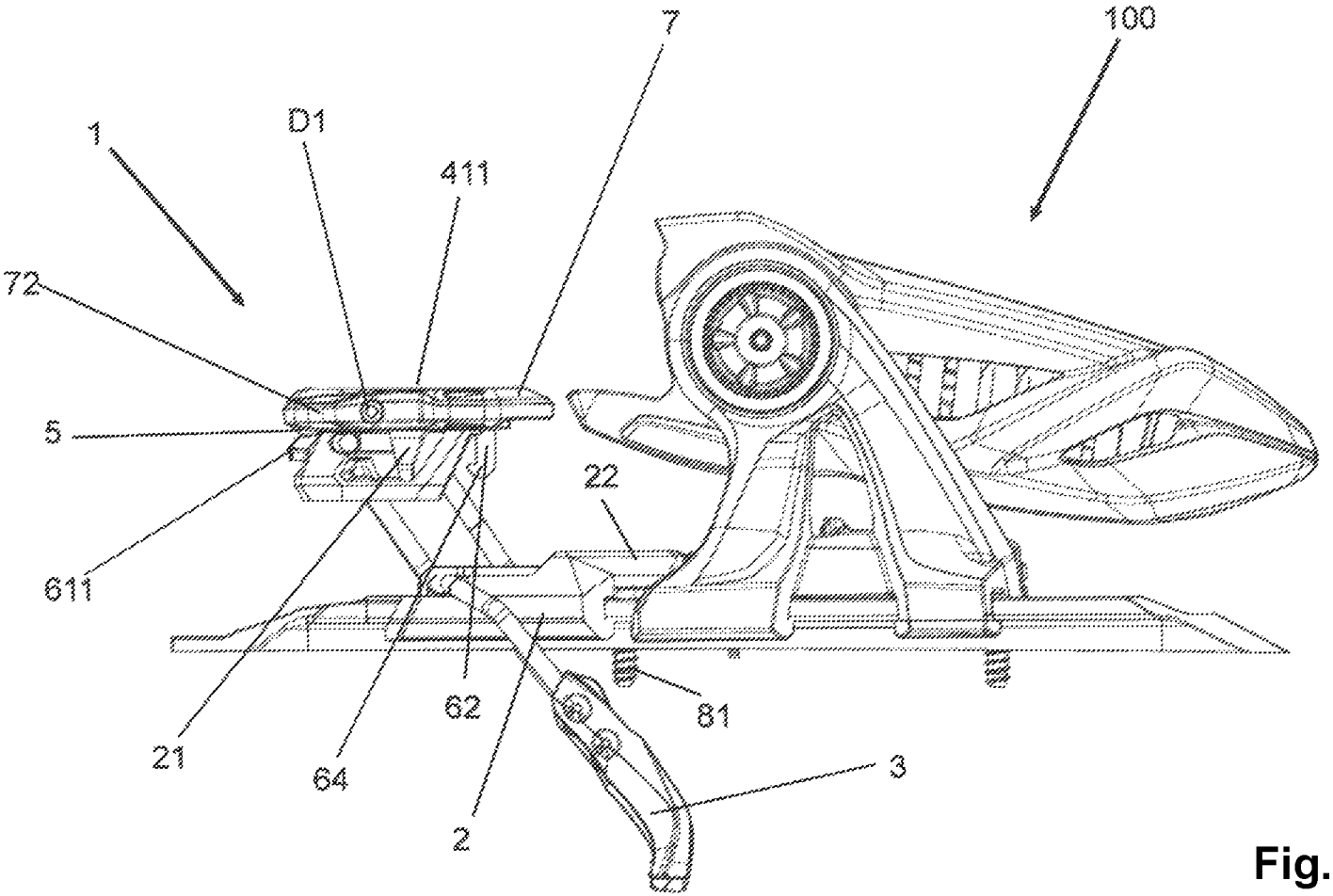
Figure 6:
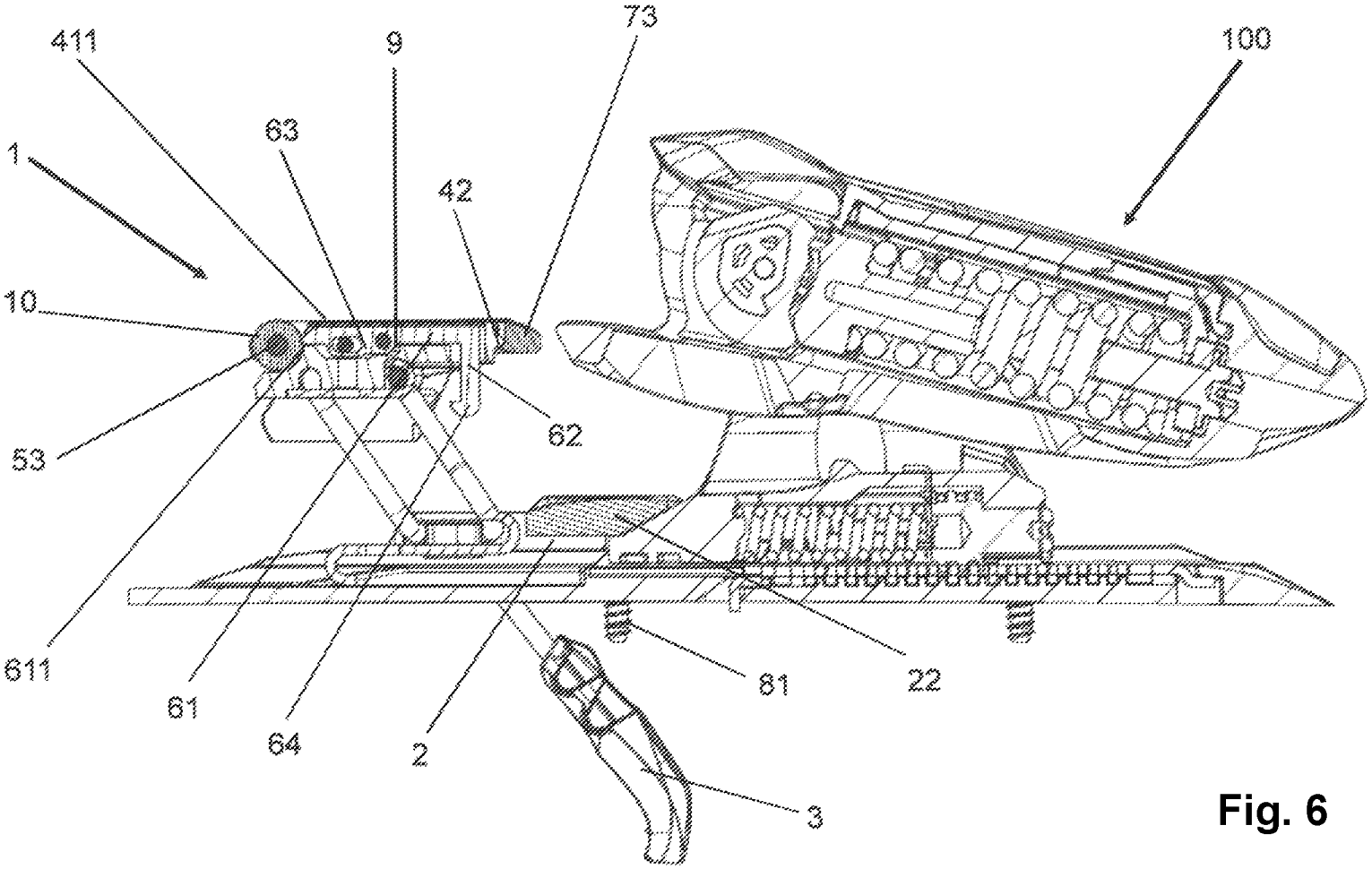
Figure 7:
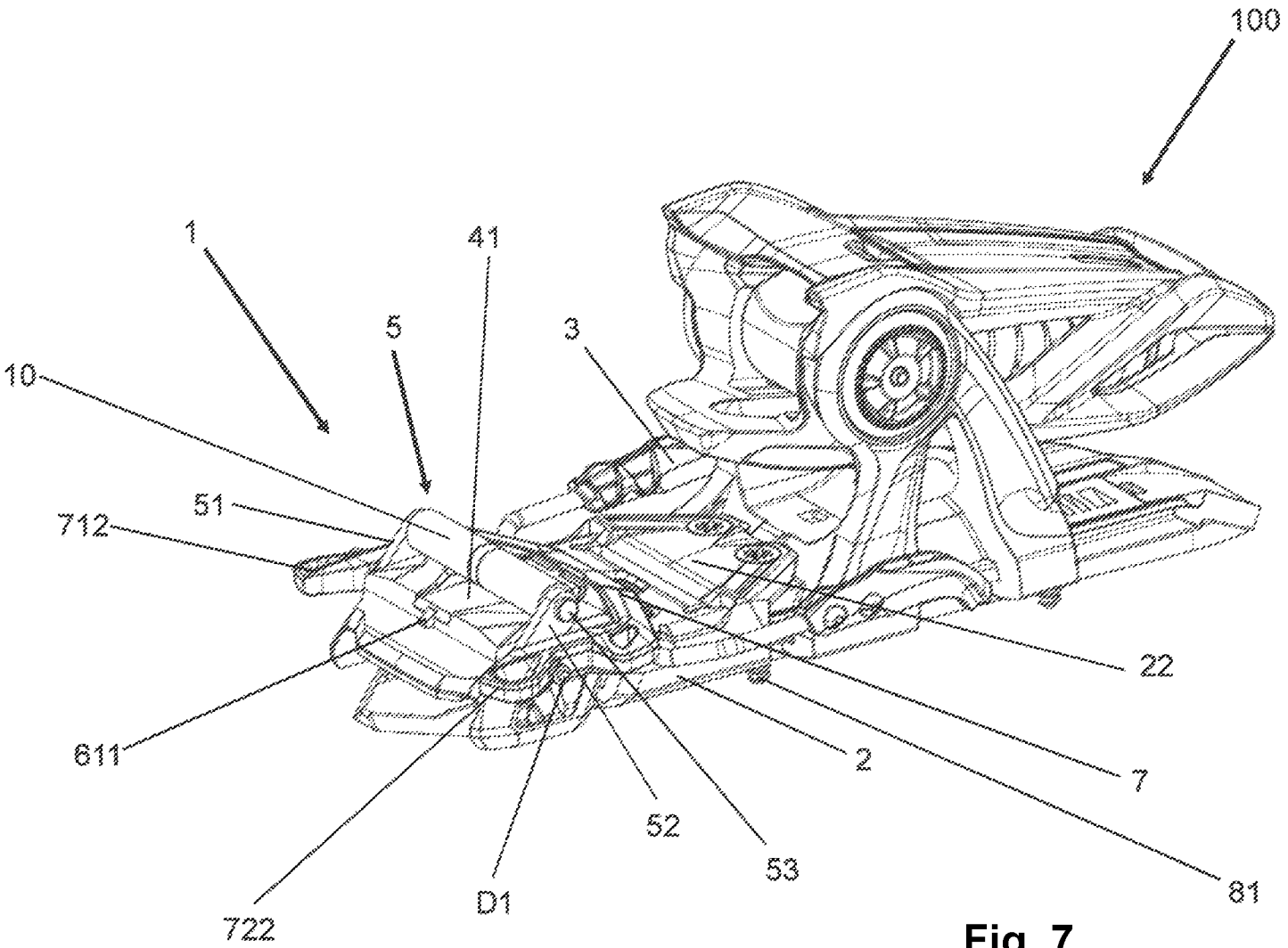
Figure 8:
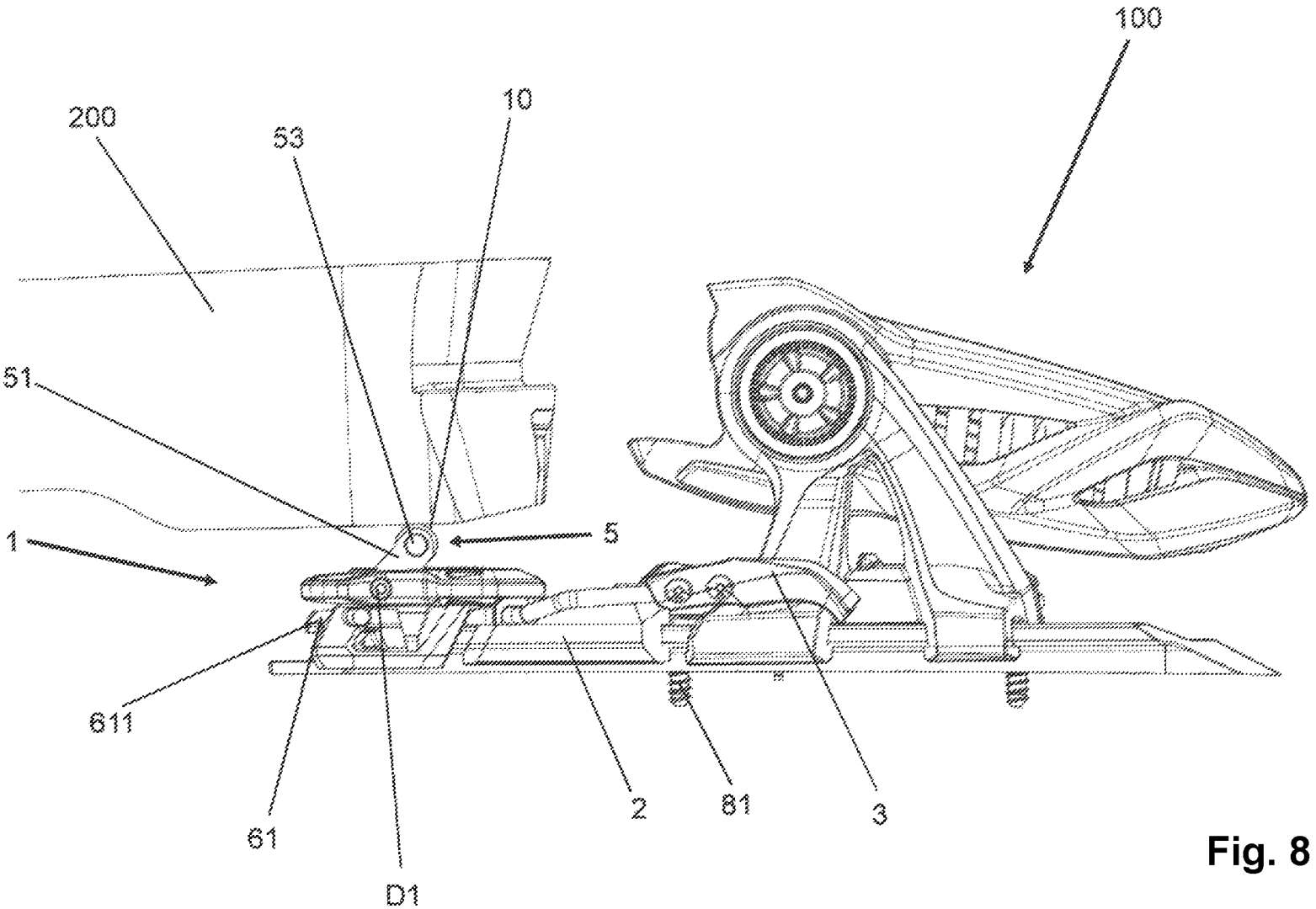
Figure 9:
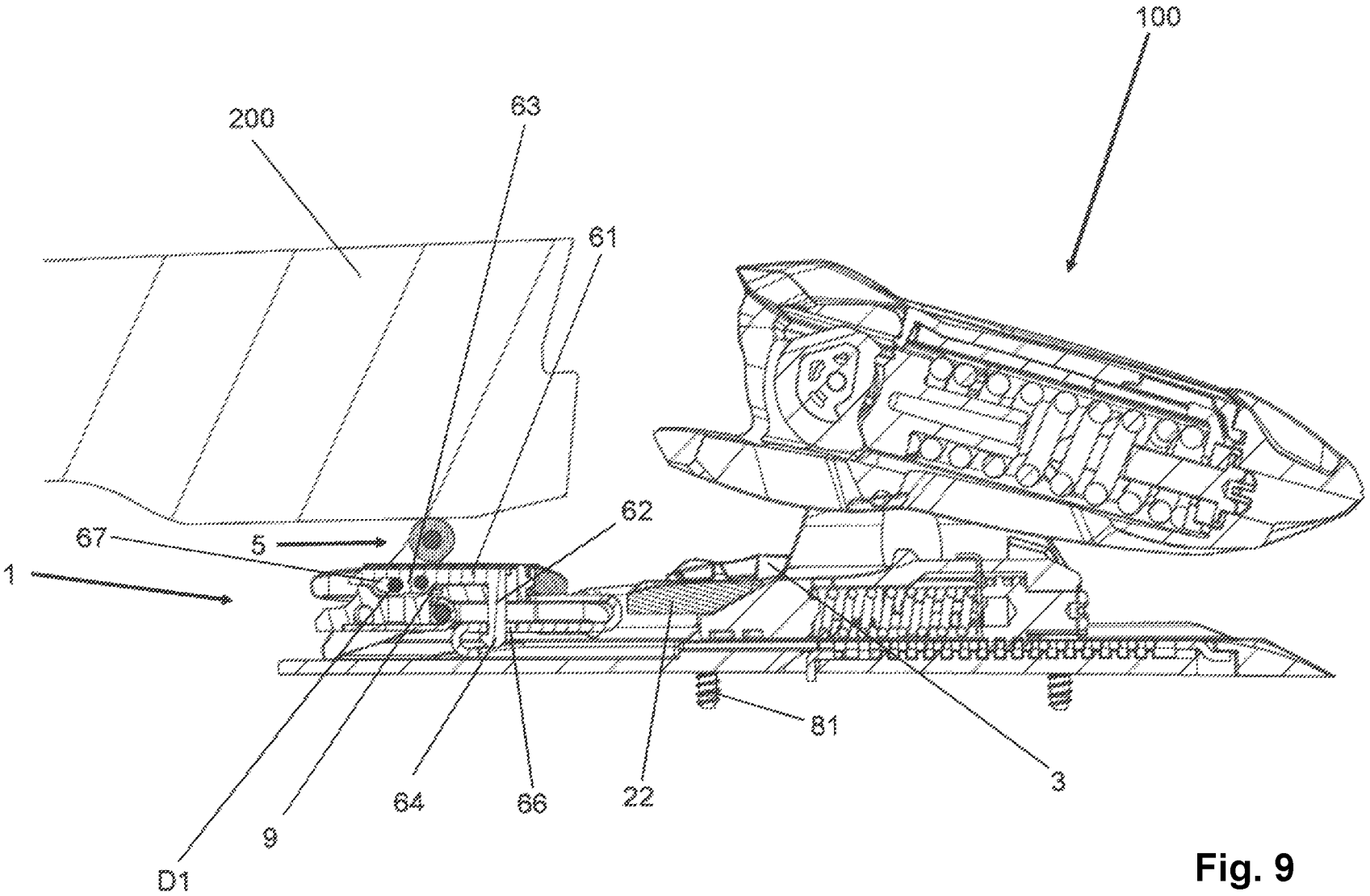
Figure 10:
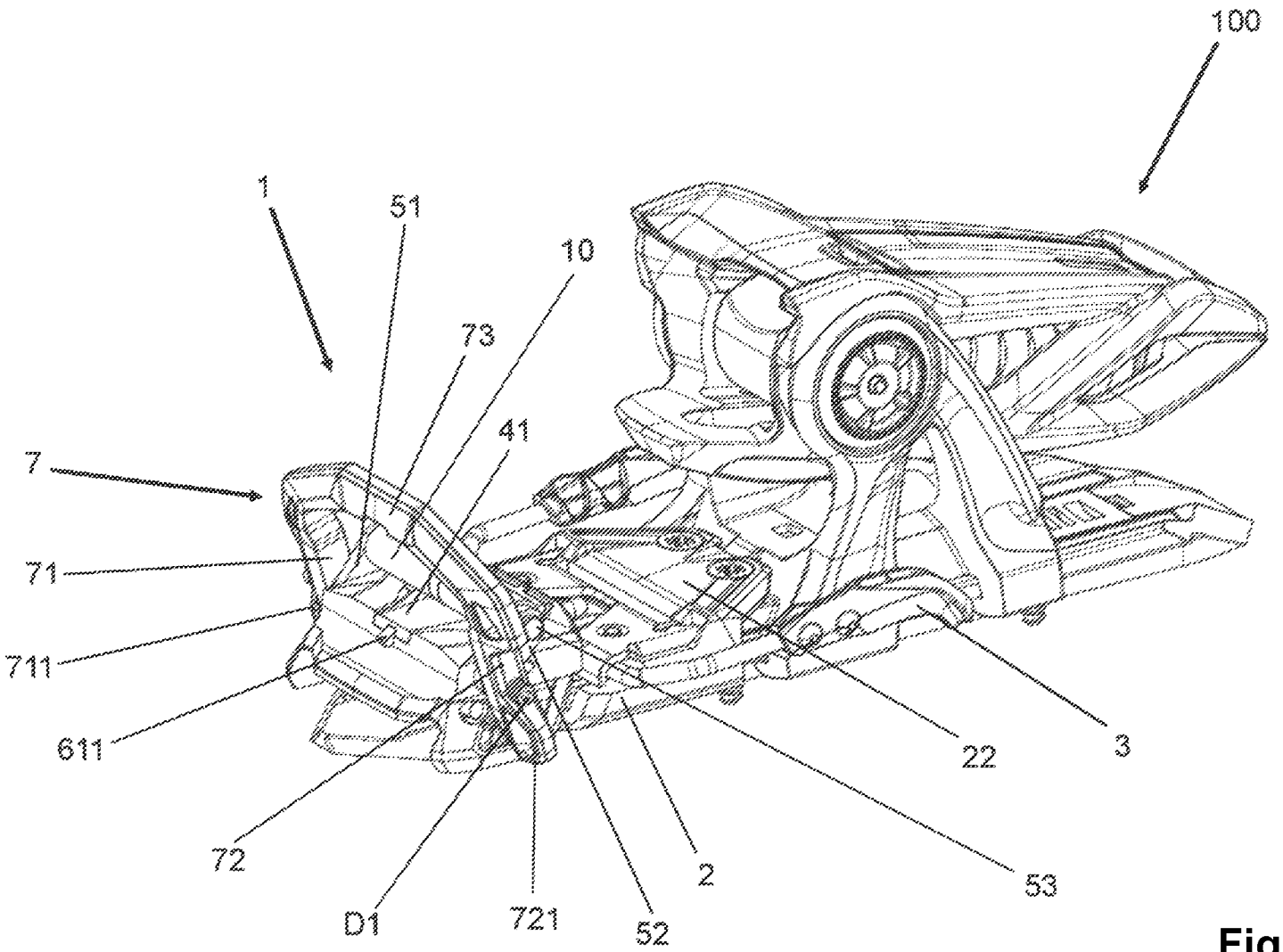
Figure 11:
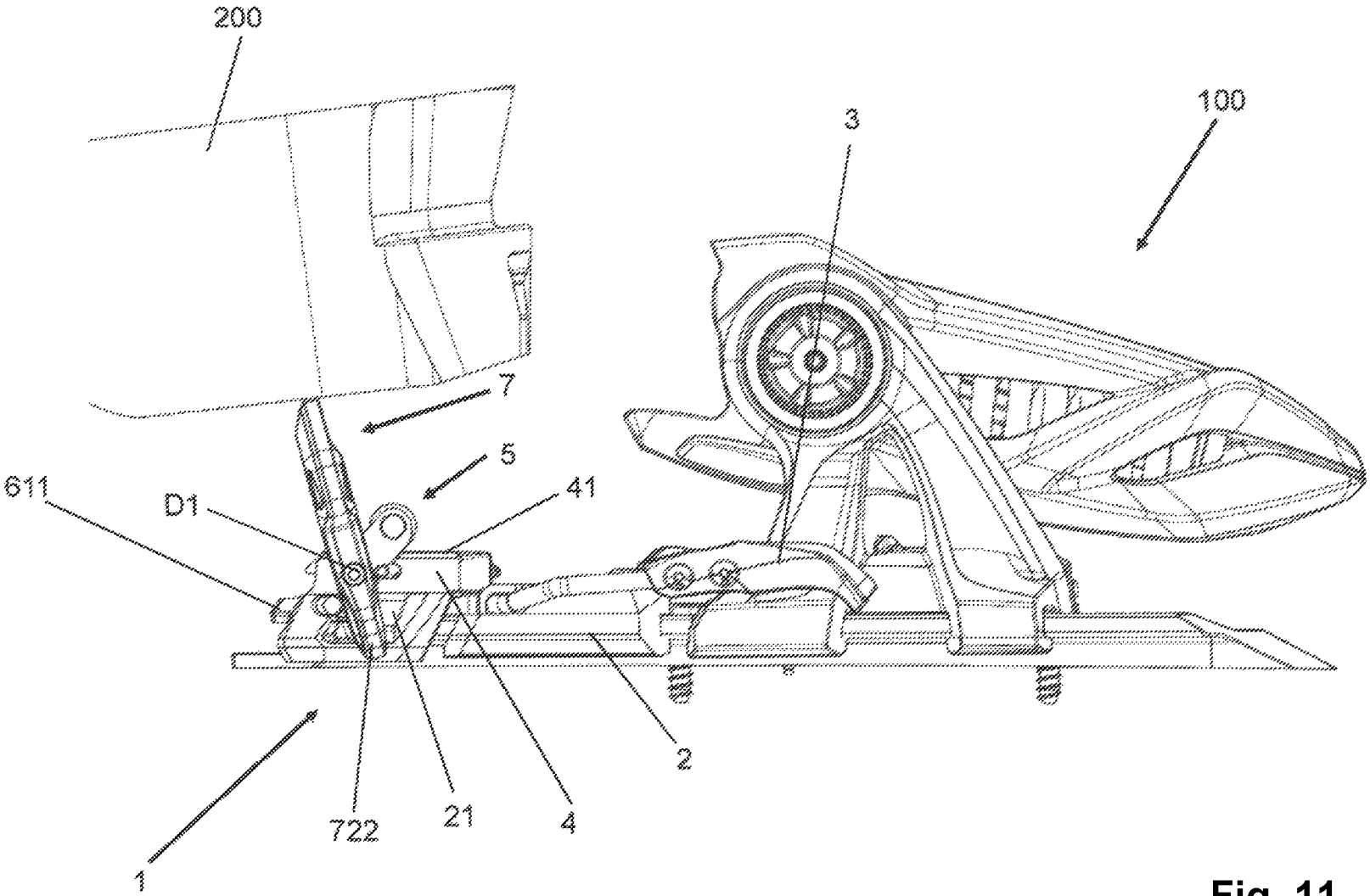
Figure 12:
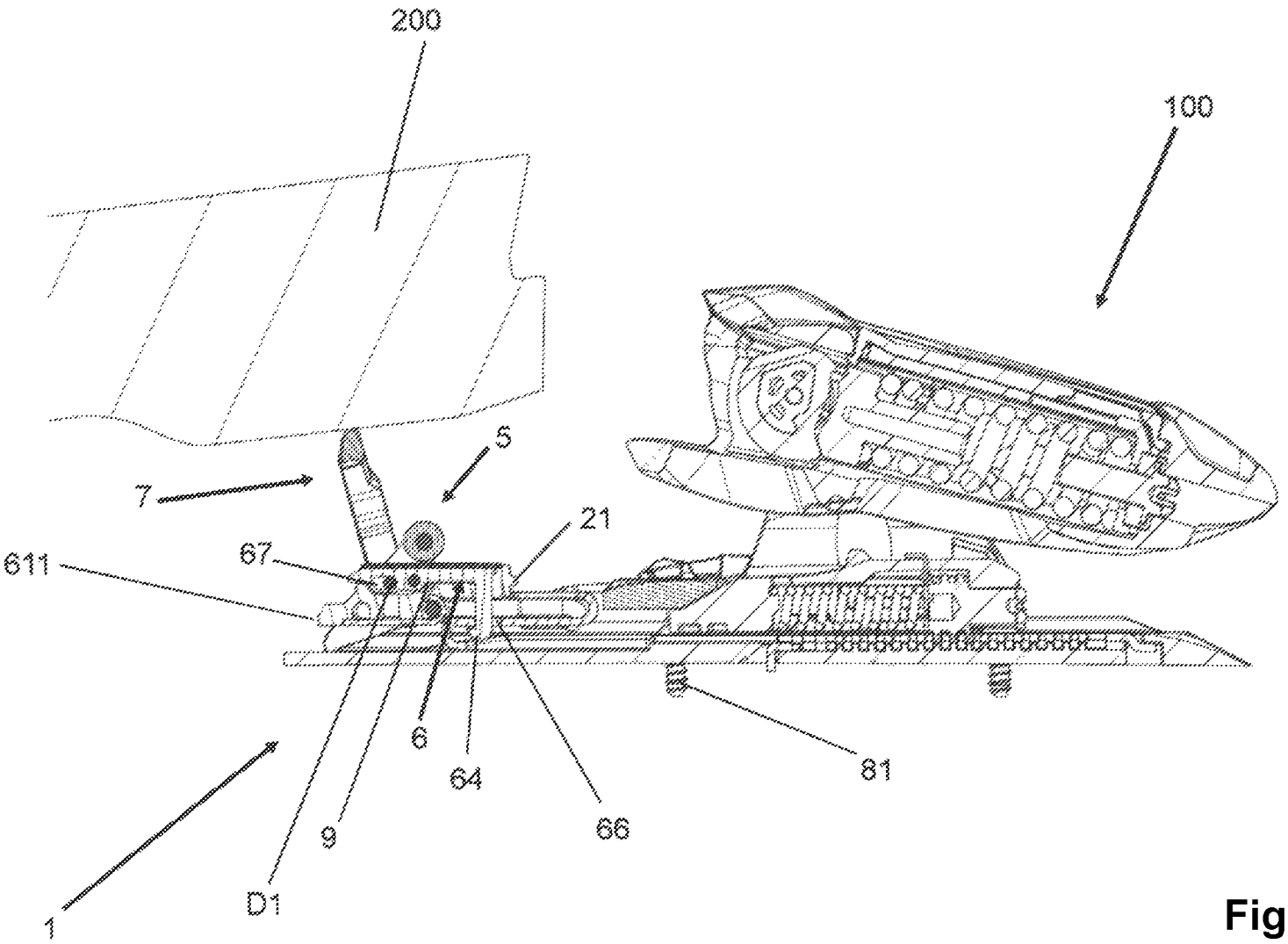

The individual figures show:

FIG. 1 a perspective view of a heel jaw plus brake device, in the downhill position;

FIG. 2 a lateral view of the heel jaw plus brake device of FIG. 1, with a boot inserted;

FIG. 3 a sectional view of the heel jaw plus brake device of FIG. 2;

FIG. 4 a perspective view of the heel jaw plus brake device, with the brake activated;

FIG. 5 a lateral view of the heel jaw plus brake device of FIG. 4;

FIG. 6 a sectional view of the heel jaw plus brake device of FIG. 5;

FIG. 7 a perspective view of the heel jaw plus brake device, in the walking position, with the functional element in the second location;

FIG. 8 a lateral view of the heel jaw plus brake device of FIG. 7, with a boot inserted;

FIG. 9 a sectional view of the heel jaw plus brake device of FIG. 8;

FIG. 10 a perspective view of the heel jaw plus brake device, in the walking position, with the second ascending aid in the active position;

FIG. 11 a lateral view of the heel jaw plus brake device of FIG. 10;

FIG. 12 a sectional view of the heel jaw plus brake device of FIG. 11.

DETAILED DESCRIPTION

FIG. 1 shows an example embodiment of a heel retainer 100 comprising a brake device 1 for a sliding board binding or ski binding, in particular a binding with which the sliding board can be used in a touring mode and in a downhill mode.

The brake device 1 comprises a base 2, a pedal 4 and at least one brake element 3 which is pressed against the underlying surface, such as for example ice or snow, in order to slow the sliding board which has detached from the boot.

The base 2 comprises a connecting region 22 which exhibits a drill hole pattern 8 and which is arranged next to the pedal 4 in the longitudinal direction L of the brake device. The drill hole pattern 8 is designed such that it aligns with a drill hole pattern of the heel retainer 100 (not visible in FIG. 1), such that the brake device 1 and the heel retainer 100 can be jointly connected to the sliding board using the same fastening element 81.

In the example embodiment, the base 2 is slid onto a rail which can be connected to the sliding board or which is formed in part by the sliding board. The pedal 4 lies in front of or next to a heel jaw of the heel retainer 100 in the longitudinal direction L of the brake device.

The pedal 4 comprises a bearing area 41 featuring a surface 411. A functional element 5, a second ascending aid 7 and a latching element 6 (see FIG. 3), of which only the free end 611 is visible in FIG. 1, are connected to the pedal 4.

In the example embodiment, the functional element 5 and the second ascending aid 7 are mounted in the pedal 4 such that they can be moved in a common rotary joint D1 and can be pivoted relative to the pedal 4 in the rotary joint D1. The functional element 5 and the second ascending aid 7 can also be connected to the pedal 4 in separate rotary joints.

The functional element 5 comprises a first connecting arm 51 and a second connecting arm 52 which each comprise a first end 511, 521 and a second end. The second end of the first connecting arm 51 is connected to the pedal 4 in a first pivot joint, and the second end of the second connecting arm 52 is connected to the pedal 4 in a second pivot joint. The rotary joint D1 comprises the first pivot joint and the second pivot joint.

The first end 511 of the first connecting arm 51 and the first end 521 of the second connecting arm 52 are connected to each other by a transverse strut 53. The transverse strut 53 is rotatably mounted in the first connecting arm 51 and the second connecting arm 52 and/or can comprise a sleeve 10 which is rotatably mounted on the transverse strut 53. The transverse strut 53 can comprise a sheath made of a preferably elastic material such as for example plastic or rubber. The sleeve 10 can comprise a corresponding exterior layer or can be formed from the elastic material.

In the example embodiment, the second ascending aid 7 is U-shaped and comprises a first connecting arm 71, a second connecting arm 72 and a transverse strut 73 which connects the first connecting arm 71 and the second connecting arm 72 to each other. The first connecting arm 71 and the second connecting arm 72 each have a free end 711, 721, each of which comprises a drill hole 713 with which an axle of the rotary joint D1 engages. The first free end 711 forms a first abutting element or locking finger 712, and the second free end forms a second abutting element or locking finger 722. These abutting elements 712, 722 can be moved or pivoted in the rotary joint D1 up to a locking element or abutment 21. When abutting the abutment 21, the second ascending aid 7 is in the active position (see FIG. 10) with a height adjustment of about 10° in the example embodiment.

The second ascending aid 7 also comprises at least one grip 74 using which the second ascending aid 7 can be moved, by hand or by means of an implement such as for example the tip of a ski pole, from the resting position shown in FIG. 1 to the active position shown in FIG. 5 and back. The grip 74 can project laterally from one or both connecting arms 71, 72 and can be joined to the second ascending aid 7 or originally molded with the second ascending aid 7 in one piece, for example in a casting or die-casting method. The second ascending aid 7 can be manufactured from a metal or a plastic, preferably a reinforced plastic, or can comprise at least one of these materials.

FIG. 2 shows a lateral view of the heel retainer 100 and the brake device 1 of FIG. 1, wherein a boot 200 is indicated which is held in the heel jaw of the heel retainer 100 for descending on the sliding board.

The pedal 4 of the brake device 1 is shown, in which the rotary joint D1 is formed which connects the functional element 5 and the second ascending aid 7 to the pedal 4 such that they can be moved. Of the second ascending aid 7, the second connecting arm 72 comprising the grip 74 is shown. The ski boot 200 which is placed on the pedal 4 holds the brake elements 3 in the position shown, in which they cannot produce any braking effect for the sliding board. Also shown are the base 2 of the brake device 1 and a connecting element 81 which connects the heel retainer 100 and the brake device 1 to the sliding board in aligned drill hole patterns.

FIG. 3 shows a sectional view of FIG. 2 along or parallel to the longitudinal direction L of the brake device. This sectional view shows how the second ascending aid 7 is secured in the resting position on the pedal 4 in a positive fit and in a force fit, such that the ascending aid 7 cannot be independently moved from the resting position shown to the active position shown in FIG. 10. In the example embodiment, the pedal 4 comprises a stud 42 with which the transverse strut 73 can lock in order to secure the second ascending aid 7 in the resting position on the pedal 4.

The latching element 6 is mostly guided in the pedal 4 and participates in the movements of the pedal 4. The latching element 6 comprises a first arm 61 or main arm which extends substantially parallel to the surface 411 of the bearing area 41. The first arm 61 has a free end 611 which abuts the transverse strut 53 or the sleeve 10 of the functional element 5. A second arm 62 is formed at the end of the latching element 6 opposite the free end 611 and, in the example embodiment, protrudes substantially perpendicularly from the first arm 61 and forms an engaging element 64 at its free end 621 which protrudes through an opening 66 in the first position of the latching element 6 shown, such that the pedal 4 is free to be moved upwards, away from the sliding board, together with the latching element 6 when for example the sliding board detaches from the boot 200 in a fall.

In the example embodiment, the latching element 6 comprises a third arm 63 which serves as a support for a spring element or tensing element 9 which biases the latching element 6, shown in the first position, into the second position (see FIG. 9). The pedal 4 or, respectively, an abutting area for the spring element 9 in or on the pedal 4 forms another support for the spring element 9.

FIG. 4 shows the heel jaw of the heel retainer 100 in a release position in which the user can step out of the binding with their boot 200. The brake device 1 corresponds to the brake device 1 of the previously described figures and comprises the pedal 4, the brake elements 3, the functional element 5 and the second ascending aid 7. The functional element 5 and the second ascending aid 7 are connected to the pedal 4 in the rotary joint D1, such that the functional element 5 and the second ascending aid 7 can be moved relative to the pedal 4, out of the position shown.

The pedal 4, which is then free of any load, has been moved upwards in a direction away from an upper side of the sliding board by a known mechanism; the brake elements 3 have simultaneously been moved in the opposite direction. The brake device 1 or the mechanism comprises a complementary latching element 65 featuring an opening 66 in which the brake device 1 can be latched by means of the latching element 6 when the sliding board comprising the heel retainer 100 and the brake device 1 is used in the touring mode.

FIG. 5 shows a lateral view of FIG. 4, clearly showing the second arm 62 of the latching element 6 comprising the engaging element 64 to which the brake device 1 can be latched for use in the touring mode.

FIG. 6 shows a sectional view of FIG. 5. The brake device 1 comprises the functional element 5 featuring the transverse strut 53 and the sleeve 10. The second ascending aid 7 is secured against unintentionally detaching by the transverse strut 73 on a stud 42 which the pedal 4 comprises. The functional element 5 and the second ascending aid 7 are connected to the pedal 4 in the rotary joint D1. The free end 611 of the first arm 61 of the latching element 6 abuts the sleeve 10 of the functional element 5. The tensing element 9 tenses the latching element 6 in a direction away from the heel retainer 100, such that when it can be freely moved, the latching element 6 can be moved by the tensing element 9 from the first location shown to the second location shown in FIG. 9.

FIG. 7 shows the heel retainer 100 and the brake device 1, which is now secured in the touring mode, such that the load-relieved pedal 4 can no longer be moved into the position shown in FIG. 4. The functional element 5 has been moved from the first position, which it occupies in all the preceding figures, to a second position, such that the sleeve 10 is then arranged above the pedal 4 and above the bearing area 41. Unlike the example embodiment shown, the transverse strut 53 or the sleeve 10 can lie on the upper side 411 of the bearing area 41 in the second position. In this position, the functional element 5 forms a first ascending aid or walking aid, with a height adjustment of greater than or equal to 0° up to about 1°, preferably up to about 2° to 3°.

The front end 611 of the first arm 61 of the latching element 6 then protrudes further out of the pedal 4, which means that the tensing element 9 has moved the latching element 6 into the second location in which the engaging element 64 secures the brake device 1 in the opening 66. The position of the second ascending aid 7 is unchanged.

FIG. 8 shows a lateral view of FIG. 7 with a boot 200 indicated, a rear sole region of which is placed on top of the functional element 5. This view again shows how the transverse strut 53 of the functional element 5 or the sleeve 10 does not lie on the surface 411 of the bearing area 41 but is rather arranged above the surface 411, such that the transverse strut 53 and/or the sleeve 10 can be rotated if for example a distance between the boot 200 and the heel retainer 100 is briefly altered by the sliding board flexing.

The boot 200 is then arranged on the sliding board further forward than the heel retainer 100. Since, as already described, the brake device 1 and the heel retainer 100 are jointly connected to the sliding board in the same connection, this means that the boot 200 has been moved forwards relative to the sliding board, i.e. the sliding board binding comprises a front jaw (not shown) which can hold the front end of the boot 200 in two boot holding positions which are different from each other, namely a rear boot holding position for descending and a front boot holding position, which is different from the rear boot holding position, for alpine touring or for walking, i.e. as compared to the downhill position shown in FIG. 2, the boot 200 is situated further forward as viewed in the longitudinal direction L of the brake device, such that contact between the boot 200 and the heel jaw of the heel retainer 100 is prevented.

FIG. 9 also clearly shows how a front region of the first arm 61 of the latching element 6 comprises an elongated hole 67 through which the rotational axis D1 extends, such that the latching element 6 can be linearly moved relative to the rotational axis.

FIG. 9 shows a sectional view of FIG. 8, which clearly shows how the engaging element 64 of the latching element 6 protrudes through the opening 66 and has been moved away from the heel retainer 100 by the tensing element 9, such that the second arm 62 of the latching element 6 can now no longer be moved vertically, thus securely preventing the brake device 1 from being released.

The initial position for latching the brake device 1 is shown in FIG. 5. For the purpose of latching, the functional element 5 is then pivoted from the first location to the second location. The pedal 4 can be pressed onto the sliding board by hand or is preferably pressed onto the sliding board when the boot 200 is lowered. Since the engaging element 64 has already been moved into its end position—in which it can no longer pass through the opening 66—by the tensing element 9, it is shaped at the free end 621 of the second arm 62 such that during the downward movement, the edge of the opening moves it—against the force of the tensing element 9—towards the heel retainer 100 until it can be pressed through the opening 66. Once the opening 66 has been penetrated, the latching element 6 is automatically moved by the tensing element 9 back into the blocked position shown in FIG. 9. In order to open this latching, the functional element 5 is moved from the second position shown back to the first position, wherein the functional element 5 presses the front end 611 of the first arm 61 of the latching element 6 towards the heel retainer 100, such that the engaging element 64 is arranged in such a way relative to the opening 66 that it can be moved through the opening 66 again. This unlatches the brake device 1 and moves the pedal 4 away from the surface of the sliding board.

FIG. 10 shows a brake device 1 in which the second ascending aid 7 has been moved into the active position and forms a height adjustment of about 10° in the example embodiment shown. The extent of the height adjustment is dependent on the length of the connecting arms 71, 72 and the shape of the transverse strut 73, which define a bearing point or bearing line for the boot 200.

FIG. 11 shows how the locking finger 722 of the second ascending aid 7 abuts the abutment 21. The weight of the boot 200 presses the second ascending aid 7 firmly against the abutment 21.

A locking element (not shown) can additionally be formed on the pedal 4, for example in the form of a partial sphere, which the locking finger or abutment 722 has to overcome before it can abut the abutment 21. It is thus possible to prevent the second ascending aid 7 from being moved out of the active position shown by the force of gravity alone and thus pressed onto the sliding board and into the resting position when the boot 200 is lowered. Aspects of the invention encompasses other known solutions which adequately solve this problem.

FIG. 12 shows a sectional view of FIG. 11.

LIST OF REFERENCE SIGNS

1 brake device
2 base
21 abutment
22 connecting region
3 brake element, brake paddle
4 pedal
41 bearing area
411 surface
42 stud
5 functional element
51 connecting arm, pivot arm
511 first end
52 connecting arm, pivot arm
521 first end
53 transverse strut
6 latching element
61 arm
611 free end
62 arm
621 free end
63 arm
64 engaging element
65 complementary latching element
66 opening
67 elongated hole
7 second ascending aid
71 connecting arm, pivot arm
711 free end
712 locking finger, abutting element
713 drill hole
72 connecting arm, pivot arm

721 free end
722 locking finger, abutting element
73 transverse strut
74 grip
8 drill hole pattern
81 fastening element
9 tensing element, spring element
10 sleeve
100 heel retainer
200 boot
D1 rotary joint
L longitudinal direction of the brake device

The invention claimed is:

1. A brake device for a sliding board, comprising:

a base for connecting the brake device to the sliding board; and a brake, comprising:

at least one brake paddle;

a latching element which can be moved back and forth between a first position in which the brake paddle can be released in order to slow the sliding board and a second position in which the brake paddle can be fixed in a non-braking position;

and a pedal which comprises a bearing area for a boot and a functional element which can be moved relative to the bearing area, wherein moving the functional element releases the latching element to be moved from the first position to the second position, wherein the sliding board comprises a combined touring and downhill binding, wherein the functional element is mounted in the pedal such that the functional element and the pedal move together relative to the base from a walking position to a downhill position, and wherein the functional element is moved relative to the pedal to release the latching element.

2. The brake device according to claim 1, wherein the functional element can be moved from a first location, in which the functional element is not in contact with a boot which is inserted in the binding, to a second location in which the functional element is in contact with the boot which is inserted in the binding.

3. The brake device according to claim 2, wherein the functional element lies over the bearing area in the second location.

4. The brake device according to claim 3, wherein the functional element forms a first walking aid for a height adjustment of equal to or less than 3° in the second location.

5. The brake device according to claim 4, wherein the height adjustment is equal to or greater than 0° in the second location.

6. The brake device according to claim 1, wherein the functional element comprises a first connecting arm and a second connecting arm, which each have a first end and a second end, and a transverse strut which connects the first end of the first connecting arm and the first end of the second connecting arm to each other.

7. The brake device according to claim 6, wherein the transverse strut is rotatably mounted in the connecting arms and/or the second ends of the connecting arms are connected to the pedal in a rotary joint.

8. The brake device according to claim 1, wherein the latching element is biased in the direction of the second position, such that when the functional element is moved from the first location to the second location, the latching element is moved automatically into the second position.

9. The brake device according to claim 1, wherein the latching element comprises a first arm which extends substantially parallel to an upper side of the bearing area and which comprises a free end which abuts the functional element when the functional element is in the first location.

10. The brake device according to claim 9, wherein the free end is shaped such that the latching element can be moved from the second position to the first position when the functional element is moved from the second location to the first location.

11. The brake device according to claim 9, wherein the latching element comprises at least one second arm which protrudes from the first arm at an angle of greater than 0° and less than 180°, wherein the at least one second arm has a free end which forms an engaging element of the latching element.

12. The brake device according to claim 1, wherein the brake device comprises at least one ascending aid which can be pivoted from a resting position to an active position, wherein in the resting position, the ascending aid is secured on the pedal in a positive fit and/or in a force fit, such that the ascending aid cannot be unintentionally moved from the resting position to the active position.

13. The brake device according to claim 12, wherein the ascending aid is connected to the pedal in a pivot joint.

14. The brake device according to claim 13, wherein the pivot joint is a rotary joint.

15. The brake device according to claim 1, wherein the brake device is a retrofit kit for a sliding board binding.

16. A ski binding for a sliding board, comprising:

a front jaw or a toe retainer;

a rear jaw or a heel retainer; and a brake device according to claim 1.

17. The ski binding for a sliding board according to claim 16, wherein the brake device and the heel retainer overlap in regions, and a drill hole pattern of the brake device aligns with a drill hole pattern of the heel retainer.

18. A sliding board comprising a ski binding for a sliding board according to claim 16.

* * * * *